United States Patent [19]

Fleming

[11] Patent Number: 4,654,670

[45] Date of Patent: Mar. 31, 1987

[54] TRACKER MOUNT ASSEMBLY FOR MICROWAVE DISHES

[75] Inventor: Terry Fleming, Roland, Ark.

[73] Assignee: Tracker Mounts Inc., Little Rock, Ark.

[21] Appl. No.: 706,461

[22] Filed: Feb. 27, 1985

[51] Int. Cl.[4] ..... H01Q 3/02; H01Q 3/08

[52] U.S. Cl. ..... 343/882; 248/183; 343/765; 343/890

[58] Field of Search ..... 343/882, 765, 766, 880, 343/892, 890; 248/183

[56] References Cited

U.S. PATENT DOCUMENTS

| | | | |
|---|---|---|---|
| 2,410,827 | 11/1946 | Langstroth et al. | 250/11 |
| 2,475,746 | 7/1949 | Kenyon | 250/33.65 |
| 3,094,303 | 6/1963 | Belger | 343/880 X |
| 3,530,477 | 9/1970 | Jarrett et al. | 343/765 |
| 3,546,704 | 12/1970 | Selby et al. | 343/765 |
| 3,714,660 | 1/1973 | Scrafford | 343/880 X |
| 3,787,870 | 1/1974 | Rocci | 343/765 |
| 3,999,184 | 12/1976 | Fuss, III | 343/765 X |
| 4,123,757 | 10/1978 | Lapp et al. | 343/766 |
| 4,199,762 | 4/1980 | Estlick et al. | 343/765 |
| 4,232,320 | 11/1980 | Savalle, Jr. | 343/765 |
| 4,346,386 | 9/1982 | Francis et al. | 343/765 |
| 4,384,294 | 5/1983 | Crook et al. | 343/709 |
| 4,433,337 | 2/1984 | Smith et al. | 343/765 |
| 4,475,110 | 10/1984 | Hutchins | 343/766 |

*Primary Examiner*—Daniel M. Yasich
*Attorney, Agent, or Firm*—Stephen D. Carver

[57] ABSTRACT

A tracker mount assembly for securing, aiming and controlling microwave satellite dish antennas. The tracker mount assembly preferably includes a rigid, central rectangular frame adapted to be disposed over a supporting surface by an elevating stanchion. The carriage-like frame includes a pair of adjustable, frame wings which are pivotally coupled to the frame sides and ultimately support the receiving antenna. These wings may be adjusted relative to the sides of the frame upon which they are secured to selectively vary declination. An elongated, rigid central frame member is pivotally journaled between the frame front and rear. Frame elevation is adjusted by variations between the angular orientation of the central frame member and its lower support structure. A spur gear rigidly secured to the latter central frame member is meshed with a frame-mounted, motorized worm gear assembly so as to vary azimuth of the antenna by forcing the frame carriage (and thus the wings) to pivot relative to the central frame member. A motor control circuit includes limit control means comprising mercury switches for controlling maximum azimuthal frame travel. Electronic tracking of azimuthal position is facilitated by a direct drive potentiometer axially coupled to the journaled central frame member, and electrically connected to the circuit means.

8 Claims, 15 Drawing Figures

FIG. 9
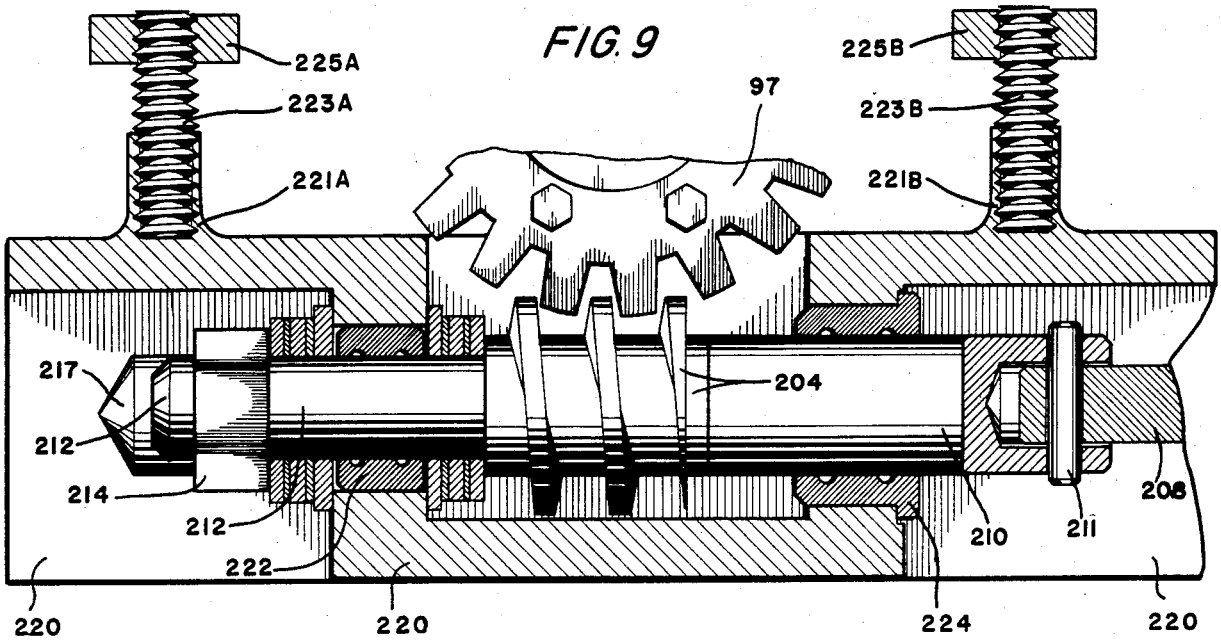
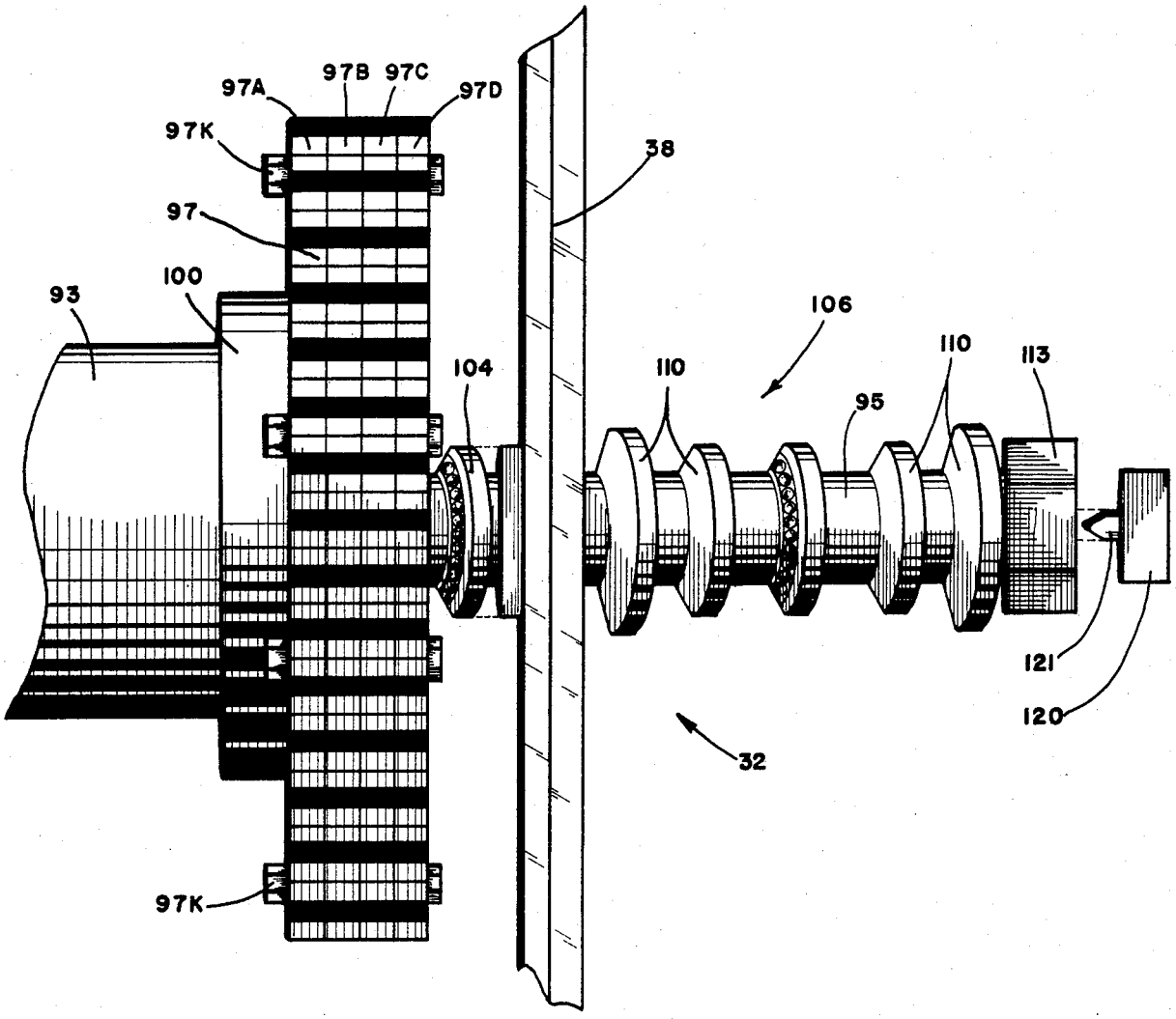
FIG. 10

TRACKER MOUNT ASSEMBLY FOR MICROWAVE DISHES

BACKGROUND OF THE INVENTION

This invention relates generally to polar mounting devices for ground based, dish antennas for receiving satellite-originated microwave transmissions. More particularly, the present invention is directed to a polar tracker mount which selectively varies antenna aximuth after appropriate installation and selection of declination and elevation.

Well known prior art satellite tracking antenna mounting systems track across selected bands of the sky in response to cooperating, substantially concurrent movement of multiple mechanical drive elements. True "polar mount" ground based satellite antenna tracking systems, however, are designed to "track" across a narrow arc or band of sky in response to prime movement from a single mechanical drive motor (and its associated linkage).

The hour angle axis is parallel to the polar axis of the planet Earth. The usually parabolic dish receiving antenna must be mounted for azimuthal tracking about a declination axis dependent upon installation latitude. Another consideration for polar mount antennas is that the hour angle axis be oriented parallel to the polar axis of the earth and perpendicular to the equatorial plane of the earth. The mounting carriage of such polar mount antennas must be mounted at different angles of inclination relative to the installed position upon the earth's surface. Thus antenna tracker mounts of the characteristics described herein must adapt for different angles of inclination to provide for proper elevation. Provisions must also be effectuated for setting up an appropriate declination angle between the antenna parabola and its support frame. Also, to provide proper antenna elevation, the mount must properly incline the antenna-bearing frame.

The declination angle must therefore be adjustable by the installer of the tracker mount system. Elevation adjustments based on latitudes are also required to properly aim the antenna at equatorial orbiting geosynchronous satellites. After declination and elevation angles are properly established during installation and assembly of the tracking apparatus, operational movement of the antenna in a "left to right" or "right to left" direction (i.e. hour angle movement) will facilitate the aiming at and thus selection of various satellites. Such aximuthal adjustments of course be user controlled in order to point the antenna towards the selected one of the many currently orbital geosynchronous satellites.

A variety of prior art microwave antenna mounting devices are known. As will be appreciated by those skilled in the art, the satellite downlink receiver dishes, generally made of fiberglass in several wedge-shaped pieces which are connected together to form a concave dish, must be mounted in a way that permits the user to aim the dish in the direction of orbiting satellites to receive a signal. The user must be able to "track", or trace across an equatorial band of sky to aim at the desired satellite transmitting the preferred microwave signal. The mount must be able to precisely orient the receiver dish, and declination and elevation settings must be precisely established within tolerances of very few degrees. The satellite transmitters are spaced approximately four to seven degrees apart in orbit around the earth (and may be spaced at a minimum of two degrees apart); thus precise positioning of the dish is essential to proper reception. Moreover, mechanically reliable and trustworthy means are necessary to suitably establish and maintian proper declination and elevation.

Moreover, user selectable variable azimuth changes must be facilitated with a maximum of speed but with a minimum of "tracking lash" or aiming error. As an antenna swings toward its intended target, it may tend to stay in motion even after appropriate electrical and electro-mechanical control apparatus signals the drive motor(s) to stop. Such travel error or drive lash is a major problem in the industry, and the problem tends to become worse with age and wear of the conventional drive systems of which I am aware.

A desired satellite receiving dish mount must be designed so as to achieve balance and stability as well as flexibility in positioning. The size, weight and dimensions of conventional parabolic satellite receiver dishes make mounting a cumbersome task. Prior satellite dish mounting devices have employed various means of facilitating the movement of the dishes, including the use of suspended frame members, hand crank devices driven by a series of threaded adjustment members, and multiple gear trains. Presently I am unaware of any suitable prior art capable of achieving all the necessary and desirable elements of precise aim, stability, and balance, coupled with concurrent qualities of easy declination and elevational set-up adjustments.

U.S. Pat. No. 4,433,337 teaches a gyro and pendulum weight passive stabilization system. The system is designed specifically for mounting an antenna on an ocean-going ship and is comprised of several separate stabilizing systems connected by electrical signal transmission means. U.S. Pat. No. 4,232,320 teaches a mounting device which is not a polar mount. The hour-angle adjustment mechanism may be operated only manually and with great difficulty, as it requires the movement and careful balancing of the entire system of support struts. U.S. Pat. No. 3,546,704 references a tracking system designed to accomodate mammoth earth stations and is not comparable to the art designed specifically for consumer microwave reception systems. The latter reference employs a motorized chain driven mount for pivotal adjustment, and a ball screw jacking arrangement for azimuthal movements.

U.S. Pat. No. 3,999,184 describes a polar mount which requires the use of at least two separate motors for tracking functions. U.S. Pat. No. 2,475,746 teaches the use of gimbal rings for stabilization of a radar antenna unit. This is, however, not a true polar mount. The structure of U.S. Pat. No. 3,787,870 requires the use of a rectangular turret base swinging on a stationary, horizontal structure. U.S. Pat. No. 3,350,477 teaches a tracking device which functions by a series of drive motors fixed to a permanent base, the positioning of which is dependent upon a motor driven screw shaft pivotally connected to the microwave antenna dish. U.S. Pat. No. 4,346,386 describes a system for mounting a radar antenna which employs two or more motors and is adapted to provide rotational and translational motion. Estlick et al., U.S. Pat. No. 4,199,762, define a system for mounting a missile scanner, which comprises a gimbal and pedestal assembly. The system employs two motors an provides improved stability and balance through the use of multiplicity or balance weights and gyros. An early scanning device is disclosed by Langstroth et al. in U.S. Pat. No. 2,410,827, which includes rack and pinion drive means to selectively sweep the scanner in a spiral or conical pattern. U.S. Pat. No. 4,384,294 describes a dual-actuator system adapted to provide improved stabilization for a ship-borne antenna system.

SUMMARY OF THE INVENTION

A true "polar mount" tracker mounting assembly for effectuating proper polar mounting of microwave antennas such as conventional parabolic microwave receiving dishes or the like.

Preferably the tracker mount assembly includes a carriage-like, generally rectangular frame which is adapted to be suspended above a supporting surface such as a lower concrete platform or the like by a rigid, vertically upstanding elongated stanchion. The generally rectangular frame includes a pair of rigid, spaced-apart, elongated and parallel sides terminating in spaced-apart, parallel side members. The rigid side members intersect the frame front and rear, and may be secured thereto as by welding or the like. Preferably the front and back frame members are comprised of channel steel or the like.

A pair of rigid, generally planar and elongated frame wings are coupled in pivotal relation to opposite sides of the frame carriage. These frame wings are in substantial parallel abutment with the frame sides and they may be pivoted with respect thereto. Opposite terminal ends of the frame wings are adpated to be mechanically coupled directly to supporting flanges coupled to the antenna dish superstructure. By pivoting the frame wing members with respect to the frame carriage, a proper angle of declination may be adjustably established for use of the antenna system. Preferably declination angle calibrations are suitably marked upon the frame interior, and they are "read" in relation to the edges of the moveable wings. The installer is thus aided in setting up declination.

A central frame member of rigid, generally tubular steel is pivotally, centrally secured within the frame carriage substantially equidistant betwen the frame sides. It extends from the frame rear and is pivotally coupled to the frame front. The central frame member includes a rigid, reinforced spur gear assembly which is preferably welded thereto and which cannot rotate with respect thereto. This central frame member is itself pivotally secured to a lower cap mounting system adapted to be secured to the previously described supportive elevating stanchion, whereby to install the tracker mount assembly at an operative distance above ground. Preferably an elongated, threaded elevation rod extending between the stanchion coupling system and the central frame member is provided to adjustably vary and semi-permanently establish the necessary frame carriage elevation upon installation.

Azimuth is adjusted by pivoting the frame carriage relative to the substantially stationary central frame member with a worm gear system driven by a frame mounted motor. Tracking is thus established by motive input from only one drive means. After declination and elevation have been properly adjusted in installation, the structure to be hereinafter described in detail facilitates sweeping of the equatorial band of sky in which the desired originating transmitting satellites are located. A variety of conventional electrical control systems may be employed in conjunction with the reversible worm gear motor so as to effectuate equatorial sweeping.

Travel limits are established by a pair of pivot limiting mercury switches which open when the sweep is at its opposite extremes. Moreover, complete electronic sensing of azimuthal position is ultimately effectuated by a direct drive potentiometer, which is structurally secured to the frame carriage 32. The shaft portion of the potentiometer is, however, axially linked to the axis of rotation of the central frame member, whereby frame carriage pivoting results in varying analog electrical signals developed across said potentiometer which may be processed by subsequent electronic digital circuitry for azimuth control and monitoring. This direct coupling of the potentiometer to the carriage frame effectuates direct satellite sensing, in that the wiper of the potentiometer is in effect "aimed" at the desired target, facilitating electronic monitoring of the tracking position derived from circuitry electically interconnected with said potentiometer.

Hence it is an object of the present invention to provide a rigid and reliable reinforced tracker mount assembly for microwave receiving antenna dishes.

Another fundamental object is to provide a true polar mount satellite tracker mount TVRO system for home use.

Yet another fundamental object is to provide a polar tracker mount system of the character described which effectuates azimuthal tracking of the desired arc of sky in response to mechanical movement about only one axis of rotation.

A fundamental object of the present invention is to provide a tracking system for mounting microwave receiver antennas in proper elevation and declination for subsequent reliable user selected azimuthal control and direction.

Yet another object of the present invention is to provide direct satellite sensing. It is an important feature of the present invention that direct satellite sensing is effectuated by a potentiometer directly driven in response to carriage movement.

A still further ojbect of the present invention is to provide a tracker mount assemby of the character described which may be quickly and easily installed upon a wide variety of support stanchions, trunnions, braces, mounting struts or the like, at virtually and latitude and upon terrain or ground of varying inclination and/or elevation.

Another object of the present invention is to provide a floating carriage arrangement for tracker mount assemblies characterized by independent pivoting wing assemblies for properly adjusting receiver antenna declination.

Yet another object of the present invention is to provide a tracker mount system of the character described which minimizes "back lash" associated with known tracker mount drive systems. It is am important feature of the present invention that a unique worm gear and tracking spur gear is employed to virtually eliminate azimuthal tracking error. Yet another object of the present invention is to provide an azimuthal adjustment system for a polar mount tracker system of the character described which is weather resistant, durable and rugged.

A still further object of the present invention is to provide an azimuthal-variable tracker mount carriage assembly upon which the tracking motor is securely mounted. An important aspect of the present invention is the fact that the drive motor rotates with the carriage assembly as azimuthal variances are effectuated.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 9 is an enlarged scale sectional view taken generally along line 9—9 of FIG. 2 with portions thereof omitted or shown in section for clarity;

FIG. 10 is an enlarged scale, fragmentary, exploded isometric view of the preferred spur gear and thrust bearing drive assembly;

DETAILED DESCRIPTION OF THE DRAWINGS

Figure 1:
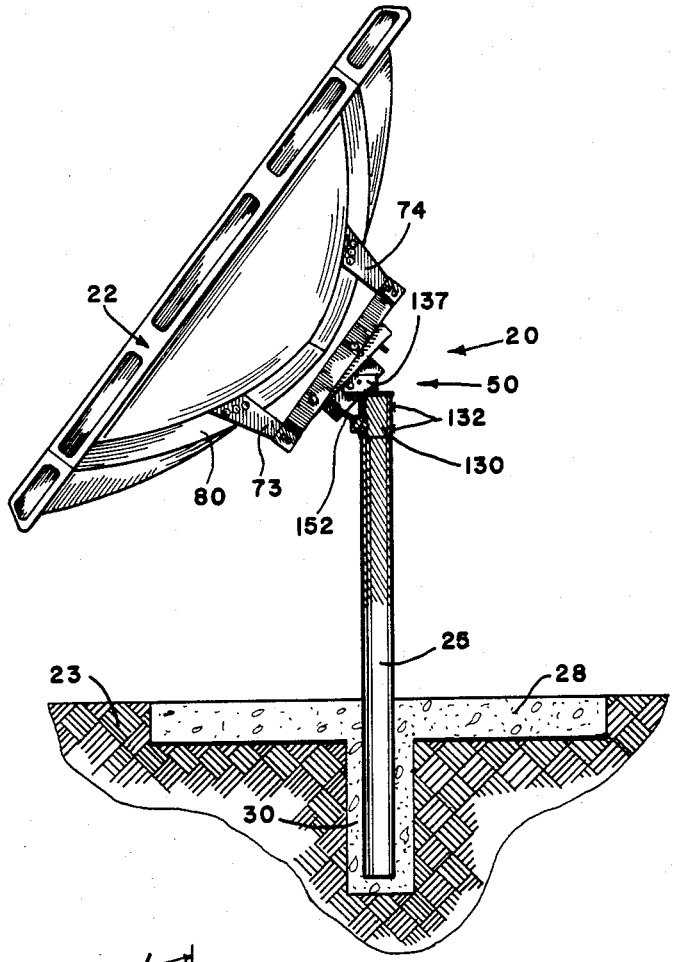
FIG. 1 is a fragmentary, pictorial view of the best mode of the present tracker mount assembly, illustrating it properly installed upon a supporting stanchion, with a conventional dish antenna properly coupled to the mount for aiming at the equatorial satellite belt.
Figure 2:
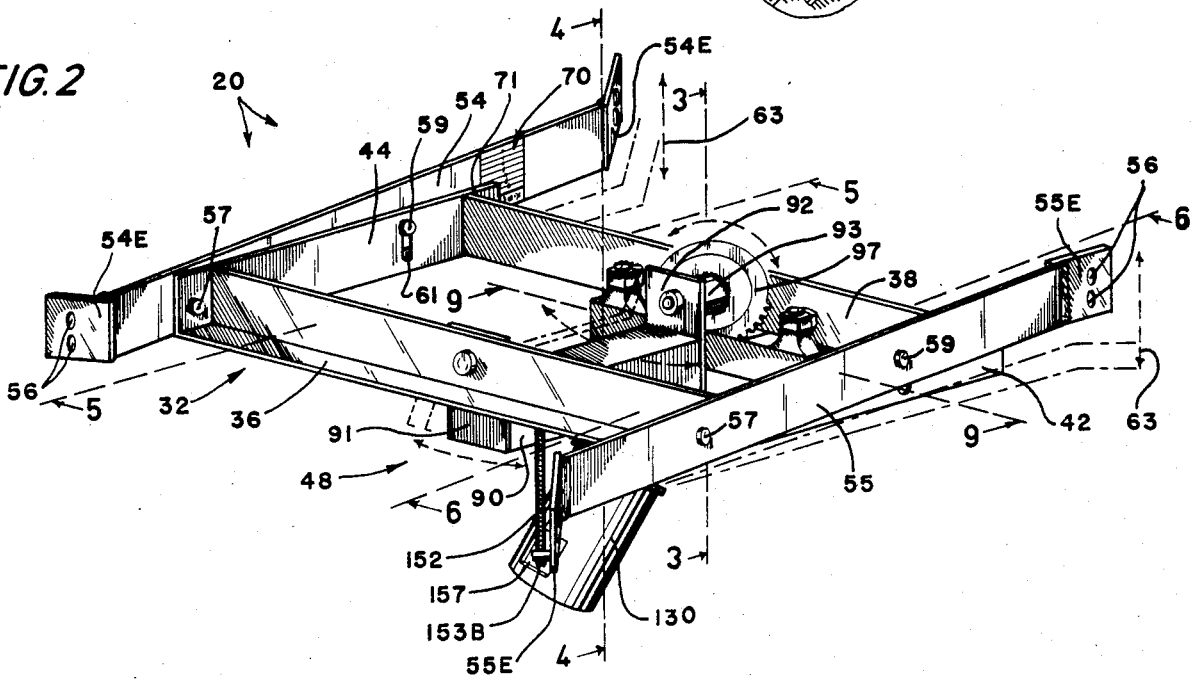
FIG. 2 is an enlarged isometric view of the tracker mount assembly of the present invention, with moved positions illustrated in dashed lines.

With initial reference directed now to FIG. 1 of the appended drawings, a polar tracker mounted assembly contructed in accordance with the best mode of the present invention has been broadly designated by the reference numeral 20. Assembly 20 is adapted to securely mount a conventional microwave dish antenna such as antenna 22 above ground 23 and to properly and accurately aim the antenna 22 towards a desired geosynchronously orbited satellite (not shown). Preferably the tracker mount assembly 20 is secured above ground 23 by a conventional, elongated, rigid stanchion 25 secured within a conventional concrete pad 28 integral with a lower concrete cylindrical anchor 30.

With additional reference now directed to FIGS. 2 through 8, the tracker mount assembly 20 of the present invention includes a generally rectangular frame carriage which has been broadly designated by the reference numeral 32. Frame carriage 32 includes a rigid, elongated channel-like, preferably steel front piece 36 and a similar spaced-apart and cooperating rear piece 38. Front 36 and rear 38 are parallel with one another and they are rigidly disposed in perpendicular relation with rigid frame sides 42 and 44. The rectangular frame carriage 32 is preferably operatively, pivotally associated with a centrally located, rigid frame member broadly designated by the reference numeral 48. The attachment means, generally designated by the reference numeral 50, to the top of the elongated support stanchion 25. As will be hereinafter explained in detail, means are provided for varying the azimuth, declination, and elevation of the antenna dish 22 supported by the tracker mount assembly 20. Declination and elevation are semi-permanently established during installation.

A pair of parallel, spaced apart frame wings 54 and 55 are pivotally coupled on opposite sides of the frame carriage 32 in substantial frictional abutment with frame sides 44 and 42 respectively. As best viewed in FIGS. 2 and 5, for example, each wing member is pivotally secured by a nut and bolt combination broadly designated by the reference numeral 57 to one side of the frame carriage. The frame wings 54, 55 may be adjusted pivotally relative to the sides of the frame carriage 32 within the limits established by the nut and bolt combination 59 which may travel within the follower slot 61 defined within opposite sides of the frame carriage. Thus, as illustrated best in FIG. 5, the frame wings 54, 55 may be pivoted up and down as indicated by arrow 63, and declination is established by reference to the declination calibration lines 70.

The declination angle calibrations 70 provide a reading relative to the upper terminal frame edge portion 71 (FIGS. 2 and 5) of the frame carriage so as to provide a direct reading in degrees of the declination angle established by wing adjustment. Once the desired declination is selected (usually 2 to 6 degrees in North America) the nut and bolt assemblies 59 are firmly tightened so that the wings are braced to the frame carriage in proper orientation relative thereto. As best viewed in FIG. 1, suitable mounting flanges 73, 74 of conventional construction associated with conventional superstructure 80 of the dish antenna 22 may be secured through conventional nuts and bolts to the outer terminal wing mounting ends generally designated by the reference numeral 54E, 55E. Suitable mounting orifices 56 disposed within the wing ends readily facilitate antenna mounting.

Figure 4:
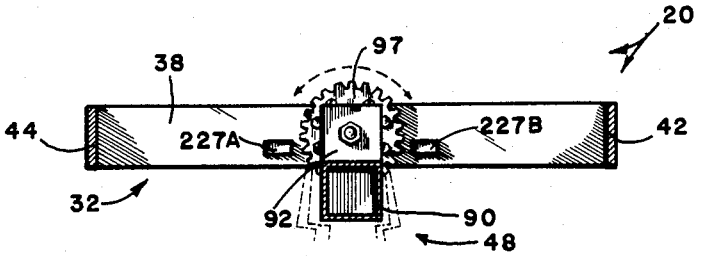
FIG. 4 is a reduced scale, fragmentary, sectional view taken generally along line 4—4 of FIG. 2, in which the wings, worm gear assembly, and drive motor of the tracker mount assembly have been omitted for purposes of clarity.
Figure 5:
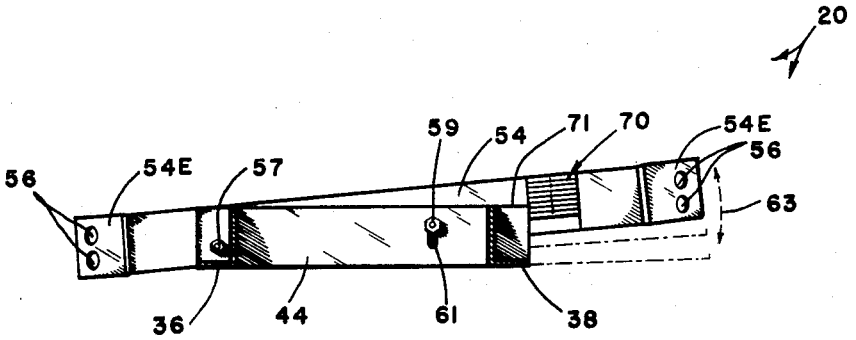
FIG. 5 is a reduced scale, fragmentary, sectional view taken generally along line 5—5 of FIG. 2 illustrating a moved position of the declination compensating wing assembly in dashed lines.
Figure 6:
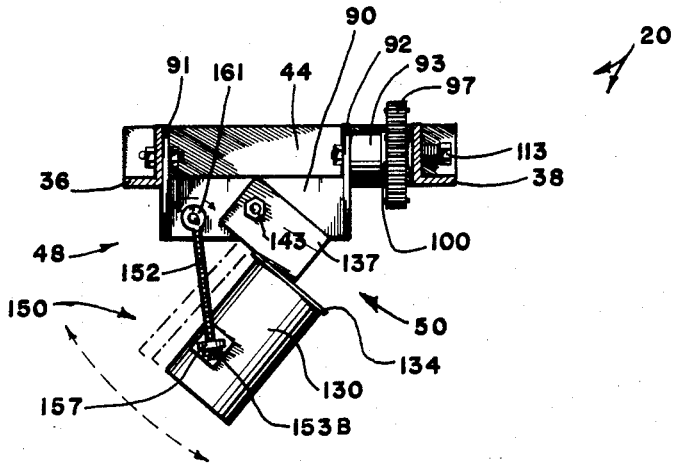
FIG. 6 is a reduced scale, fragmentary, sectional view taken generally along line 6—6 of FIG. 2 with dashed lines indicating moved positions of the azimuth adjustment structure, including the mounting cap, with portions thereof omitted for purposes of clarity.

With reference now to FIGS. 2, 6, 7, 13 and 14, the central frame member 48 comprises a rigid, generally box-like elongated portion 90 which, as indicated best in FIG. 4, is preferably of generally square cross section.

Figure 13:
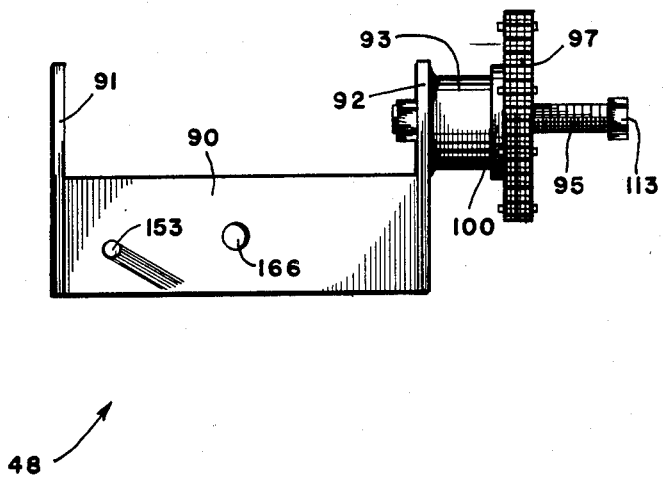
FIG. 13 is a side elevational view of the central frame section and spur gear assembly.
Figure 14:
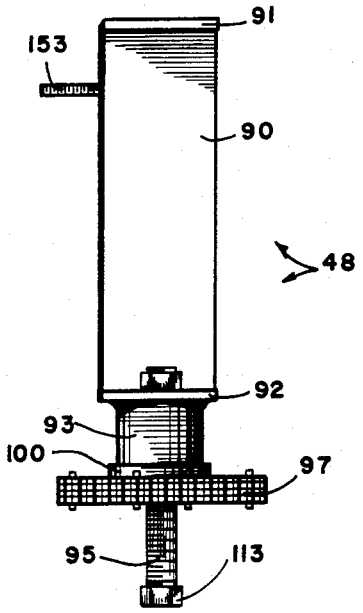
FIG. 14 is a top view of the central frame member and the associated spur gear assembly; and, FIG. 15 is an abbreviated, electrical schematic diagram of the preferred control system of the present tracker mount apparatus.

Frame member 90 preferably terminates in a front mounting tab 91 and a rear mounting tab 92 (FIG. 13). A rigid, cylindrical spacer 93 secured to tab 91 both by welding and by an elongated bolt 95 terminates in a rigid spur gear 97 and an optional, intermediate flange 100. Preferably the spur gear 97 is laminated and is formed of multiple sections 97A through 97D, which may be secured together in concentric alignment by suitable bolts 97K. This spur gear and its supportive assembly (FIGS. 7, 10) is pivotally coupled to the rear frame cross piece 38. Intermediate thrust bearing structure, generally designated by the reference numeral 104, and terminal thrust bearing structure generally identified by the reference numeral 106 is preferably included. Importantly, compression slip washers 110 facilitate frictional rotation of shaft 95 against predetermined friction from the terminal mounting bolt 113. Importantly, and as will hereinafter be described, the electrical control potentiometer, broadly designated by the reference numeral 120, has its shaft portion 121 splined for rotation relative to spur gear mounting bolt 95. Since the potentiometer body is fixedly mounted relative to the frame carriage, relative rotation between the carriage and the stationary central frame member 48 (i.e. portion 90 thereof will result in adjustments to this position sensing potentiometer.

With reference directed now to FIGS. 2, 6, 7, 11, and 12, the stanchion attachment means 50 previously discussed preferably includes a rigid, generally tubular column cap 130 of generally cylindrical construction which is adpated to be mated to the top of the cylindrical stanchion 25. Mounting bolts 132 of conventional construction (FIGS. 11, 12) secure the cap against relative torsional displacements. This cap preferably includes an upper, generally planar surface 134 from which a pair of spaced-apart, rigid, upwardly projecting and parallel mounting plates 136, 137 upwardly project. These "tabs" 136, 137, pivotally secure the column cap 130 to the central frame member 48. For example, as best viewed in FIGS. 8 and 6, tabs 136, 137 are braced by a nut and bolt 143 sandwiching the central frame member 48 for pivotal displacement therebetween.

Further structural bracing is provided by variable elevation means generally designated by the reference numeral 150. Elevation is effectuated by variable adjustment of the elevation rod 152 (FIG. 7) the ring portion 161 of which extends from the central frame member 90 being pivotally connected to outwardly projecting rod 153 (FIG. 14) and terminates in the tab 157 (FIGS. 11, 12) weldably secured to the column cap 130. Elevation may be adjusted by adjusting the nut 153B (FIGS. 6, 7) whereas to draw the central frame member toward or away from the column cap. The mounting tabs 136, 137 (FIGS. 7, 12) of the column cap are pivotally secured on opposite sides of the central frame member 90 and anchored thereto by bolt 143 which penetrates orifice 166 (FIG. 13).

Figure 3:
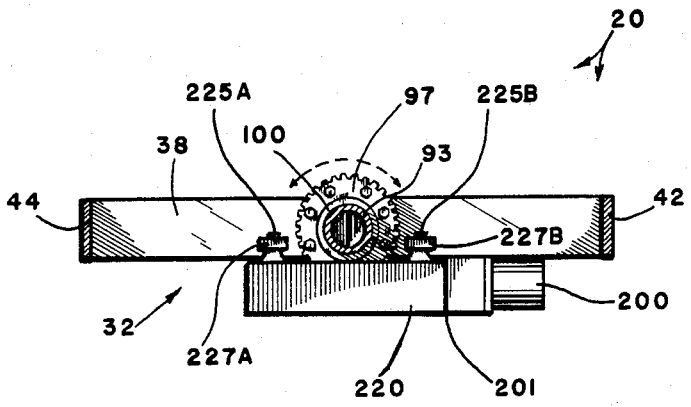
FIG. 3 is a reduced scale, fragmentary, sectional view taken generally along line 3—3 of FIG. 2, in which the wings of the tracker mount assembly have been omitted for purposes of clarity.
Figure 7:
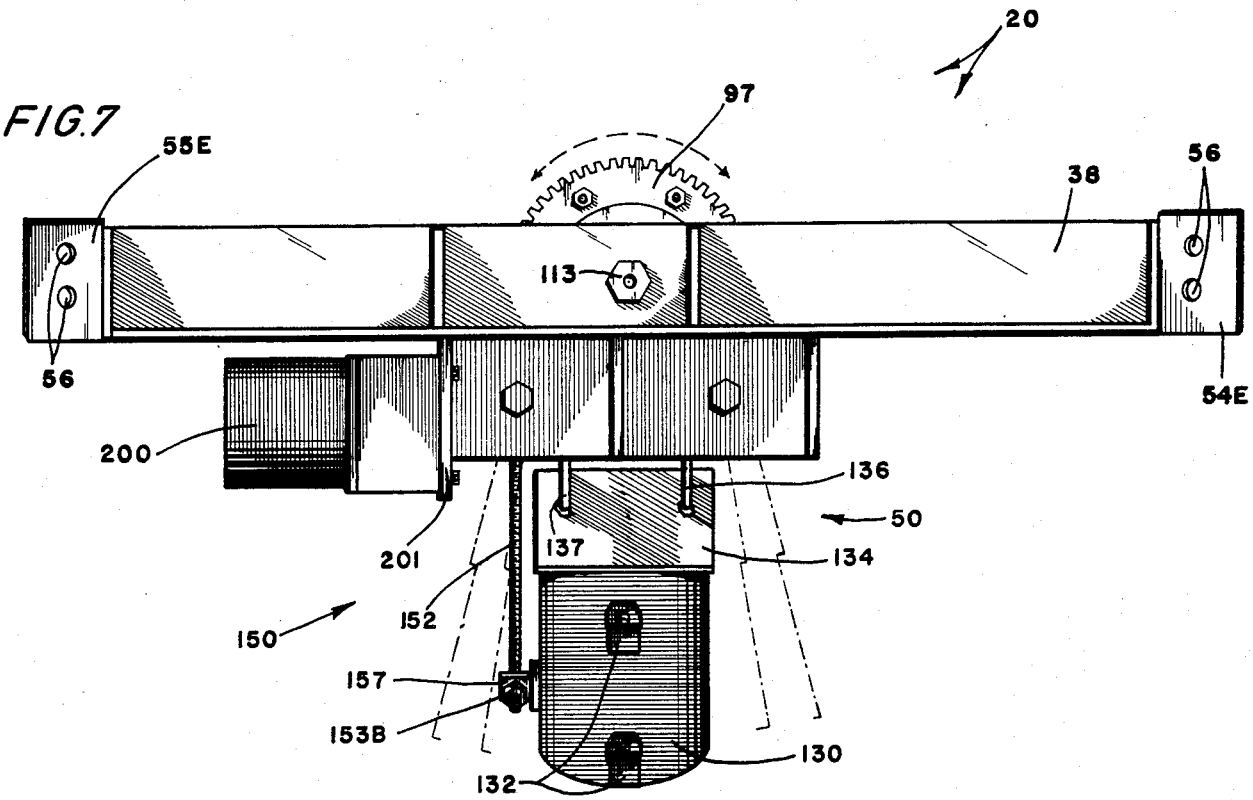
FIG. 7 is an enlarged scale, rear elevational view of the tracker mount assembly of the present invention in which moved positions have been illustrated in dashed lines.
Figure 8:
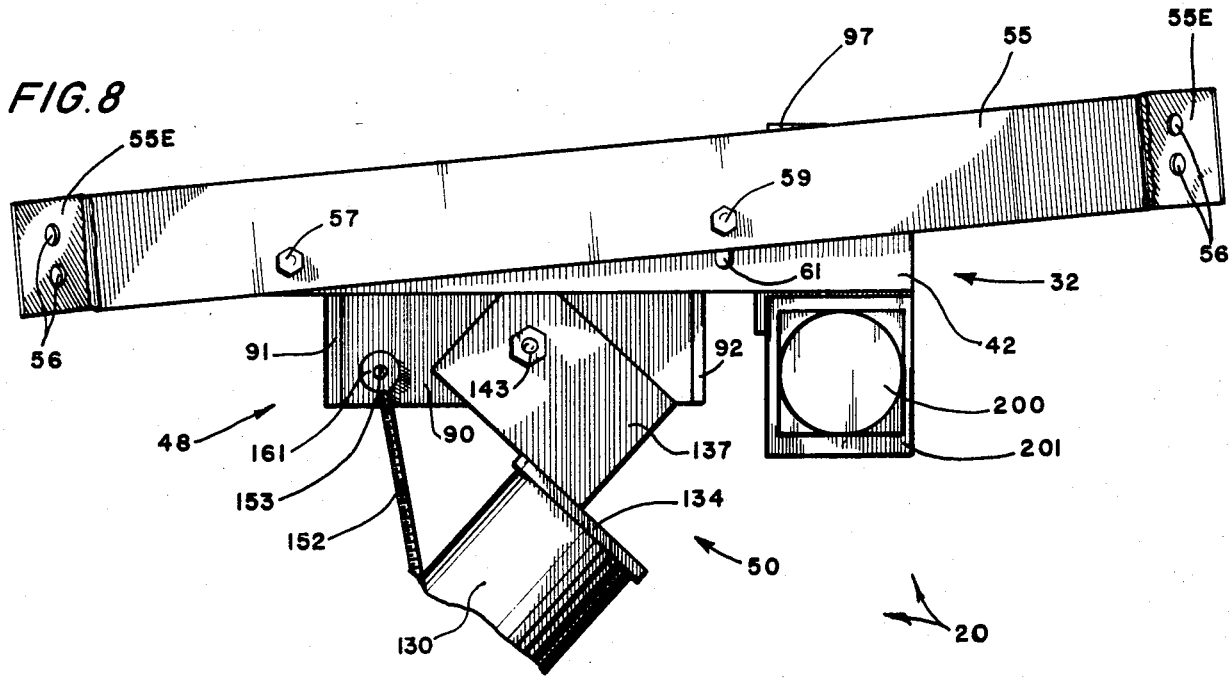
FIG. 8 is an enlarged scale, fragmentary, side pictorial view as viewed generally from a position to the left of FIG. 7, with certain portions thereof broken away or shown in section for clarity, or omitted for brevity.
Figure 11:
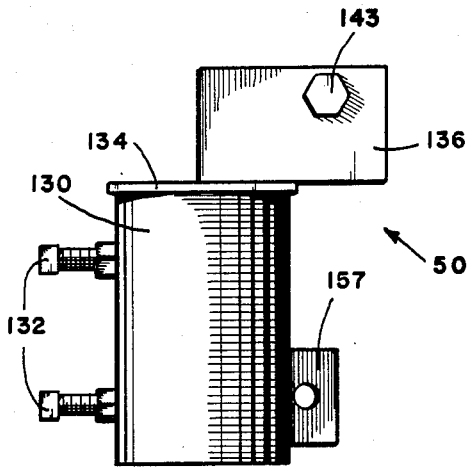
FIG. 11 is a side elevational view of the pole cap mounting assembly.
Figure 12:
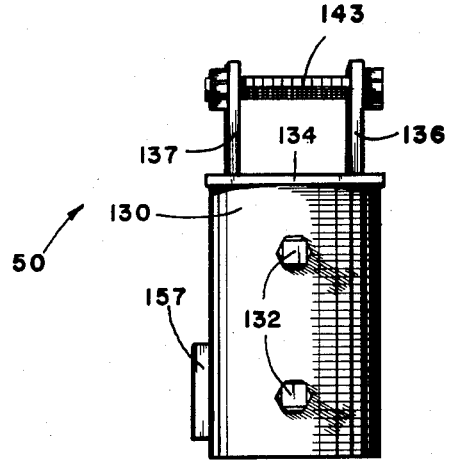
FIG. 12 is a rear view of the pole cap assembly of FIG. 11.

With reference directed now to FIGS. 3, 4, and 7, azimuth is controlled by a motor, broadly designated by the reference numeral 200, which is secured to the frame carriage through suitable bracing 210 for driving a worm gear 204 (FIG. 9) which meshes with the spur gear 97. Motor shaft 208 (FIG. 9) is splined to interior shaft 210 by a crosspin 211, turning worm gear 204 in the desired direction. The opposite reduced-diameter shaft 212 terminates in a suitable nut 214, which compresses suitable bushings 213. Shaft 212 terminates within an interior passageway 217 defined in the frame block 220 (FIG. 9). Suitable axial isolating bearings 222 and 224 are preferably secured within the frame block 220. Rotation of spur gear 97 is effectuated by activation of the motor 200, which therefore rotates worm gear 204. In conjunction with the necessary declination and elevation adjustments which are semi-permanently made during installation, azimuthal variations in aiming are thus effectuated ultimately by worm gear 204.

Frame block 220 includes integral bosses 221A and 221B upwardly rising from its opposite sides (FIG. 9) and in which suitable threaded studs 223A and 223B are permanently secured. The latter studs are fitted through integral outwardly projecting hubs 227A and 227B respectively (FIGS. 2–4) and secured by suitable nuts 225A and 225B to permanently secure the motor to the frame carriage.

In this regard, it is to be appreciated that the spur gear 97 does not rotate relative to the central frame member 48; rotation of worm gear 204 effectuates relative rotation of the frame carriage 32 relative to the semi-stationary central member 48. In this fashion, aximuthal scanning of the equatorial satellite band is accomplished. Since elevation and declination have previously been established in the manner aforedescribed, rotation of the motor-driven worm gear 204 relative to the stationary spur gear 97 will move the antenna dish through a curved arc to track the equatorial satellites desired. At the midpoint of travel of the carriage, the declination and elevation adjustments of the previously described hardware effectuate approximately the same "aiming" deviation. However, since the present polar mount aims the antennas through a "curved" band of sky, declination adjustments are most critical at the extremes of aximuthal carriage travel.

Figure 15:
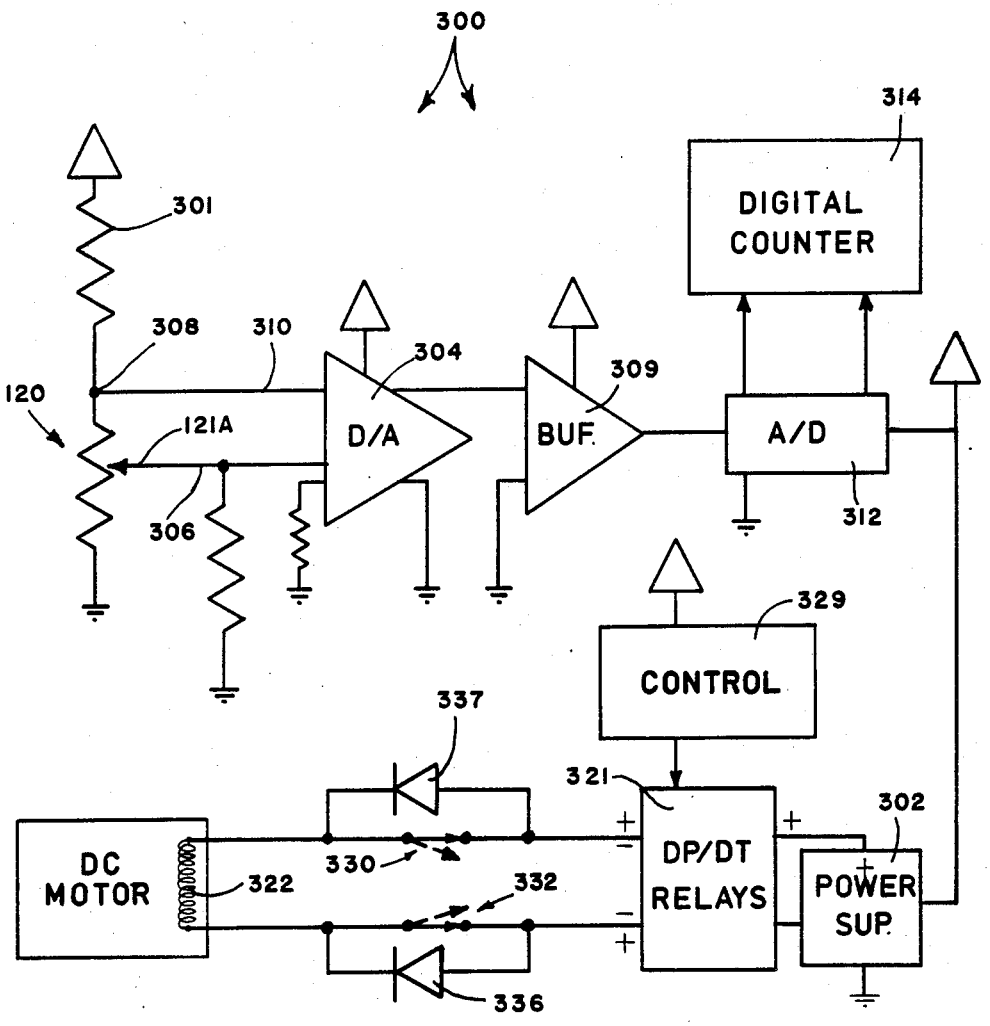

With reference now to FIG. 15, a preferred circuit for monitoring and limiting azimuthal travel is designated generally by the reference numeral 300. Circuit 300 derives power from power supply 302, and voltage is applied across resistor 301 and potentiometer 120. As azimuth changes in response to worm gear rotation, the directly driven potentiometer wiper 121A will sense different voltage references, and this reference voltage is applied to differential amplifier 304 via line 306. The constant voltage at node 308 is transmitted to another input of amplifier 304 via line 310. The output of amplifier 304 reaches the input of conventional analog-to-digital converter 312 via buffer 309, and a relative position reading is directly displayed by conventional digital counter 314.

Circuit 300 also provides motor current and effectuates azimuthal travel limits. A pair of DPDT relays, within the circuit generally designated by the reference numeral 321, transmit current to motor field winding 322 to activate the motor. The motor is automatically reversed at its travel limits in response to sensing by mercury switches 330 and 332. In operation, both switches 330 and 332 are normally "closed", as illustrated in solid lines. When, for example, the antenna has travelled to its eastern azimuthal limit, switch 332 "opens" and this is sensed by circuit 321, reversing the internal relays. Providing the operator/consumer desires to then track in a westerly direction (i.e. by adjustment of control circuit 329), motor field control current polarity is then "switched," and current momentarily flows through diode 336 until switch 332 again closes to latch diode 336.

Westerly azimuthal travel may proceed at the option of the operator, who controls circuit 329, until travel limit switch 330 opens. When the latter mercury switch opens, the resultant interrupted travel is sensed by circuit 321, which may them reverse motor field current polarity again. The antenna will turn east immediately as current initially flows through bypass diode 337. Switch 330 will soon close again to latch diode 337, and azimuthal control may proceed as desired by the consumer.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tracker mount assembly for effectuating secure mounting and polar tracking of a microwave antenna such as a parabolic dish or the like, said assembly comprising:

rigid, generally rectangular frame means adapted to be disposed above ground by a rigid elongated, stanchion for supporting said antenna dish or the like; said frame means comprising a pair of generally parallel spaced-apart rigid elongated sides and cooperating, rigid, parallel and spaced apart elongated front and rear members;

a pair of parallel, spaced-apart elongated rigid frame wings adapted to be securely pivotally coupled in substantially parallel abutment with said frame means on each of said opposite sides thereof, said wings terminating at each of their terminal ends in couplings adapted to be secured to said antenna or the like;

means for variably pivoting said frame wings with respect to said frame whereby to facilitate adjustments in antenna declination;

central frame member means of elongated, rigid construction extending between said frame front and rear members in substantially parallel equidistant relation with respect to said frame sides; said central frame member pivotally journaled with respect to said frame means and terminating in a spur gear fixedly secured in non rotatable relation relative to said central frame member means;

stanchion attachment means adapted to be permanently secured at its bottom to said stanchion and pivotally, centrally secured at its top to said central frame member;

variable elevation adjustment means associated with such central frame member means and said stanchion attachment means whereby to adjust said central frame member means and said frame means in elevation; and azimuth control means comprising:

worm gear means secured to said frame means and meshed with said spur gear; and, motor means secured to said frame means for selectively rotating said worm gear means, whereby to effectuate azimuth adjustment of said mount and thus said antenna by forcing said frame means and said frame wings to rotate relative to said central frame members means and the gear secured to said central frame means, whereby to track satellites disposed within an equatorial band at the preselected elevation and declination.

2. The tracker mount assembly as defined in claim 1 including a pair of switch elements for controlling maximum azimuth variation of said frame means.

3. The tracker mount assembly as defined in claim 2 wherein said stanchion attachment means comprising a generally tubular, column cap adapted to be rigidly secured in coaxial relation with respect to the lower, supporting stanchion, a generally planar upper vertical tab means integral with said cap means and adapted to be pivotally secured to said central frame member means; and wherein said user variable elevation adjustment means comprises an elongated, threaded rod adapted to be threadably coupled and adjustably varied in axial position between said column cap and at least a portion of said central frame means.

4. The tracker mount assembly as defined in claim 3 including electronic control means for user selecting azimuth.

5. The tracker mount assembly as defined in claim 4 including potentiometer means having a body and a twistable stem, said stem axially coupled to said gear and having a body secured to said frame means whereby to electrically sense azimuth of said assembly.

6. A polar tracking assembly for aiming, mounting and controlling a suitable microwave antenna dish, the assembly comprising:

rigid, generally rectangular frame means adapted to be disposed above ground by suitable mounting structure for supporting said antenna dish or the like; said frame means comprising a pair of generally parallel spaced-apart rigid elongated sides and cooperating, rigid, parallel and spaced apart elongated front and rear members;

a pair of parallel, spaced-apart elongated rigid frame wings adapted to be securely pivotally coupled in substantially parallel abutment with said frame means on each of said opposite sides thereof, said wings terminating at each of their terminal ends in couplings adapted to be secured to said antenna or the like;

means for variably pivoting said frame wings with respect to said frame whereby to facilitate adjustments in antenna declination;

stationary, central frame member means of elongated, rigid construction pivotally extending between said frame front and rear members in substantially parallel equidistant relation with respect to said frame sides; said central frame member terminating in a spur gear fixedly secured to said central frame member means;

attachment means adapted to be permanently secured to said mounting structure and pivotally, centally secured at its top to said central frame member;

variable elevation adjustment means associated with such central frame member means and said attachment means whereby to adjust said central frame member means and said frame means in elevation;

azimuth control means comprising:

worm gear means secured to said frame means and meshed with said spur gear; and, motor means secured to said frame means for selectively rotating said worm gear means, whereby to effectuate azimuth adjustment of said mount and thus said antenna by forcing said frame means and said frame wings to rotate relative to said central frame members means and the gear secured to said central frame means, whereby to track satellites disposed within an equatorial band at the preselected elevation and declination; and, circuit means for controlling said motor means whereby to effectuate user selectable antenna azimuth, said circuit means including travel limit switch means for controlling maximum azimuth adjustment variation of said frame means and thus said antenna dish.

7. The assembly as defined in claim 6 wherein said attachment means comprises a generally tubular, column cap adapted to be rigidly secured in coaxial relation with respect to a lower, supporting stanchion, a generally planar upper vertical tab means integral with said cap means and adapted to be pivotally secured to said central frame member means; and wherein said user variable elevation adjustment means comprises an elongated, threaded rod adapted to be threadably coupled and adjustably varied in axial position between said column cap and at least a portion of said central frame means.

8. The assembly as defined in claim 7 wherein said circuit means includes potentiometer means having a body secured to said carriage and a twistable stem, said stem axially coupled to said spur gear and rotated in response to carriage rotation, said potentiometer means electrically coupled to said circuit means whereby to electrically sense the selected azimuth of said assembly and thus the antenna dish supported thereby.

* * * * *